US005430463A

United States Patent [19]

Fontalirant

[11] Patent Number: 5,430,463

[45] Date of Patent: Jul. 4, 1995

[54] DISPLAY ELEMENT WITH TEETH ON THE ARRISES OF THE VERTICAL FACES; DISPLAY PANEL AND DISPLAY SYSTEM COMPRISING THEM

[75] Inventor: Eric Fontalirant, Soulaires, France

[73] Assignee: FM Incoming, Lagardelle sur Leze, France

[21] Appl. No.: 211,485

[22] PCT Filed: Aug. 11, 1993

[86] PCT No.: PCT/FR93/00804

§ 371 Date: Apr. 6, 1994

§ 102(e) Date: Apr. 6, 1994

[87] PCT Pub. No.: WO94/08327

PCT Pub. Date: Apr. 14, 1994

[30] Foreign Application Priority Data

Oct. 7, 1992 [FR] France ..... 92.11908

[51] Int. Cl.[6] ..... G09G 3/16

[52] U.S. Cl. ..... 345/108; 345/110; 40/473

[58] Field of Search ..... 345/108, 109, 110, 111, 345/184, 55, 84; 40/446, 470, 473, 503

[56] References Cited

U.S. PATENT DOCUMENTS

| | | | |
|---|---|---|---|
| 3,949,392 | 4/1976 | Caritato | 345/108 |
| 4,761,905 | 8/1988 | Black | 345/110 |
| 4,912,442 | 3/1990 | Black | 40/473 |

FOREIGN PATENT DOCUMENTS

| | | |
|---|---|---|
| 2610438 | 5/1988 | France . |
| 0364349 | 4/1990 | France . |

*Primary Examiner*—Ulysses Weldon
*Assistant Examiner*—Matthew Luu
*Attorney, Agent, or Firm*—George A. Seaby

[57] ABSTRACT

The invention relates to a display element and to its use in a display panel, and to a display system.

This display element is generally in the form of a cube (32) and thus comprises four display faces of different color. This cube (32) is mounted so as to rotate on fixed shafts (34), in column $C_n$ and in row $R_m$. These cubes include rotation means such as teeth and erasing means such as a recess.

By virtue of the these rotation means such as teeth and these erasing means such as a recess, the rotating of a display element is simplified, and more foolproof and reliable, which improves the operation of the display panel made up of such display elements.

33 Claims, 8 Drawing Sheets

DISPLAY ELEMENT WITH TEETH ON THE ARRISES OF THE VERTICAL FACES; DISPLAY PANEL AND DISPLAY SYSTEM COMPRISING THEM

The present invention relates essentially to a display element with teeth on the arrises of the vertical faces; display panel and display system comprising them.

Document FR-A-2,610,438 from the same inventor already discloses a display element formed by a cube with display toothing and erasing toothing, as well as display panels comprising such display elements and a display system. In this prior solution, the cubes comprise teeth associated with horizontal axial faces, the teeth being arranged substantially perpendicularly to the associated vertical lateral face and in an off-centred manner.

This prior solution has given satisfaction, but separately required an upper writing toothing and a lower erasing toothing, which led in turn to a considerable size of the display cubes.

The object of the present invention is therefore to solve the new technical problem consisting in supplying a solution making it possible substantially to reduce the size of the display elements, thus making it possible to increase the precision of the image.

A further object of the present invention is to solve the new technical problem consisting in supplying the solution making it possible to simplify the implementation of the writing system, as well as to improve the distribution of friction when rotating the display elements.

A further object of the present invention is to solve the new technical problem consisting in supplying a solution making it possible to prove greatly the display and/or erasing speed, particularly so that the scanning speed can be at least equal to or greater than 0.3 m/s while exhibiting high security in positioning the display elements with a minimum risk of error.

The present invention makes it possible to solve these new technical problems for the first time in a simultaneous way, which is particularly simple, less expensive, and can be used on an industrial scale. The invention thus makes it possible to construct large surfaces of display panel whilst retaining simplified management of the display and of the erasing while even improving the reliability.

Thus, according to a first aspect, the present invention provides a display element including a member in the form of a block including at least one first axial face and one second axial face arranged horizontally, or vertically, substantially parallel to each other and joined together by a plurality of vertical or horizontal lateral faces constituting display surfaces of different colours, and arranged substantially perpendicularly to the said first and second axial faces, defining junction arrises with the latter, the said member forming a block including an axial through orifice the axis of which is substantially perpendicular to the said axial faces and intended to receive a rotation support element, the said member forming a block comprising means for rotating about the said rotation support element, so that it can present each lateral face in the display position in succession, the said rotation means being intended to be controlled by rotation control means for displaying or erasing a given colour in order to define or erase an item of information in conjunction with other identical display elements, characterized in that the rotation means comprise first mechanical means termed display means allowing a given colour to be displayed, and arranged on each of the lateral faces, rotationally secured to the latter, and controlled by the said control means, and second mechanical means termed erasing means making it possible to reposition to an initial colour, arranged on just one of the said lateral faces, controlled by the said control means; preferably, the control means comprise first control means controlling the first mechanical display means and second control means separate from the first control means and controlling the second mechanical erasing means.

According to an advantageous embodiment, the first mechanical display means comprise a tooth arranged off centre towards one arris of the face which supports it, intended to interact with the aforementioned control means, the said tooth projecting outwards with respect to the overall surface of the said face which supports it. Advantageously, the tooth occupies a substantial part of the dimension of the arris.

According to a particular embodiment, the tooth is integral with the face which supports it and preferably in continuity with this face, for example having a curved surface for joining to the face.

According to a particular embodiment variant, the curved surface has a dimension which is less than or at most substantially equal to half the dimension of the face which supports it in the rotation direction.

According to yet another particularly advantageous embodiment variant, the height of the tooth with respect to the overall surface of the face which supports it lies between 8 and 20% of the dimension of the said face in the rotation direction.

According to a particularly advantageous embodiment, the aforementioned erasing means comprise a recess produced level with just one arris on a lateral face which is intended to be opposite the lateral face including the erasing colour. Preferably, the aforementioned tooth occupies the whole dimension of the arris on at least three aforementioned lateral faces and on a fourth face the said tooth occupies only part of the dimension of the arris in order to define the aforementioned recess constituting the erasing means.

According to a particular embodiment, the recess has a surface which is substantially in the plane of the face which supports it.

According to another particular embodiment variant, level with the arris including the recess, the surface of the recess is slightly set back with respect to the overall surface of the face including the recess so as to facilitate the passage of the erasing means.

According to a currently preferred embodiment, the aforementioned member in the form of a block is of substantially cubic shape and thus comprises four lateral faces.

According to an equally advantageous embodiment, the member in the form of a block is produced from an injectable material, using an injection technique, preferably made from an injectable plastic such as polybutyleneterephthalate.

According to another particularly advantageous embodiment, the colours of the lateral faces are obtained by a hot marking technique, for example by depositing a film of given colour on the lateral face, possibly followed by depositing a lacquer giving a mechanical strength preventing the colour from being damaged and protecting the colour particularly against ultraviolet radiation.

According to another advantageous embodiment, the aforementioned display element is characterized in that it comprises an element for braking the rotation of the block-shaped member, the element preferably being arranged inside the axial orifice. Advantageously, the aforementioned braking element comprises a ratchet-type toothing allowing just one direction of rotation, including as many teeth as there are display surfaces, preferably including four teeth when the display element includes only four lateral faces.

According to a second aspect, the present invention also provides a display panel comprising a structure with a display surface formed by a multiplicity of display elements arranged at predetermined intervals in the vertical direction and spaced apart by a predetermined distance in the horizontal direction in order to form horizontal rows of display elements ($R_m$) and vertical columns of display elements ($C_n$), characterized in that each display element is such as defined previously.

According to a particular embodiment, the display elements are mounted so as to rotate about a vertical axis of rotation (Y—Y), the display elements being mounted so as to rotate per column ($C_n$) or row ($R_m$) on fixed rotation shafts arranged in columns or rows, all of these fixed shafts being mounted on a chassis acting as a frame defining the aforementioned display surface; the display elements rest on spacing and holding strips which are spaced apart at predetermined intervals so as to define either columns, or rows of display elements.

According to an advantageous feature, the interval between the aforementioned spacing strips is identical to the distance between the aforementioned fixed shafts.

According to a particular embodiment, the spacing strips comprise a plurality of orifices traversed by the aforementioned fixed shafts, the said orifices being arranged at the anticipated distance in order to define the aforementioned columns or rows.

According to an advantageous embodiment, the aforementioned spacing strip comprises means for supporting and guiding the aforementioned rotation control means.

According to a particular embodiment, the spacing strip comprises a plate arranged substantially horizontally, including the aforementioned orifices and provided at a lateral edge with a moulding defining the aforementioned support and guidance means.

According to a particular embodiment, the aforementioned control means comprise a longitudinal structure provided with a plurality of indexes which can move, by aforementioned line or column, moving in parallel to the rear of the plane formed by the display surface which consists of the display elements.

According to a particular embodiment, the aforementioned display panel is characterized in that it comprises first rotation control means comprising a first longitudinal display structure provided with a plurality of display indexes which can preferably move individually and independently, per line or column, moving in parallel to the rear of the plane formed by the display surface which consists of the display elements and in the plane of the first aforementioned mechanical display means.

According to a preferred embodiment, this display panel is also characterized in that it comprises second rotation control means, comprising a second longitudinal erasing structure provided with one or more erasing indexes, in particular one or up to four indexes for a member forming a block consisting of a cube with four lateral faces forming four display faces of different colour.

According to an advantageous embodiment, the aforementioned display indexes are mounted so that they pivot independently, individually, about a pivot spindle actuated by electromechanical or pneumatic control means; advantageously the erasing index(es) is/are mounted so that it (they) can move, and preferably so that it (they) pivot(s) about an associated pivot spindle actuated by electromechanical or pneumatic control means.

According to a currently preferred embodiment, the second longitudinal erasing structure is mounted on the first longitudinal display structure, and in front of this first longitudinal structure.

According to a particular embodiment variant, the indexes are arranged with a predetermined identical spacing which is preferably equal to or greater than twice the distance separating the rotation spindle of two adjacent display elements.

According to another particularly advantageous embodiment, each aforementioned display index comprises an active surface which, in the working position abuts in its displacement against the aforementioned tooth in order to rotate the aforementioned display element whilst the aforementioned movable erasing index has an active part which, in the working position, is arranged level with the aforementioned recess.

According to a particular embodiment, the display indexes have the form of a strip including a front edge and a rear edge, the front edge constituting a stop for rotating the display element, forming the active surface.

According to a particular embodiment variant, the aforementioned strip has an excess thickness at its front edge defining a stop, the difference in thickness preferably being substantially identical to the height of the aforementioned tooth so that the rear edge comes to bear against the tooth of a given face and the front edge bears on the surface of the said face of a display element preceding the display element the tooth of which is to be tilted by rotating the said element.

According to a particularly advantageous embodiment, the erasing index comprises a strip including a front edge and a rear edge, the front edge including an excess thickness defining a stop, on only part of its dimension, corresponding to the dimension of the aforementioned recess, the said stop forming the active surface being intended to be positioned facing the said recess.

According to a third aspect, the present invention further covers a display system, characterized in that it comprises at least one display panel such as defined previously, which preferably forms part of a peripheral display unit, advantageously equipped with an internal computer system.

According to an advantageous embodiment, this display system is also characterized in that it comprises a service centre for managing a set of images sent to at least one peripheral display unit comprising at least one aforementioned display panel.

It can thus be understood from the foregoing that the present invention makes it possible to solve the technical problems expounded previously in a simultaneous, particularly simple, reliable manner which can be used on the industrial scale. The invention makes it possible, as expounded previously, to reduce substantially the size of the display elements, in particular of the display cubes, which makes it possible to increase the precision of the image and to simplify the implementation of the reading/erasing system. In contrast, particularly owing to the fact that the teeth are produced according to the present invention over all or exceptionally over part of the height of the arrises or lateral faces of the display elements, a better distribution of friction is obtained when set in rotation. Furthermore, the display/erasing speeds are improved and may be equal to or greater than 0.3 m/s, this being with high precision and reliability, particularly, preventing any rebound or reverse rotation.

Other objects features and advantages of the invention will emerge clearly in the light of the explanatory description which will follow, given with reference to the appended drawings representing a currently preferred embodiment of the invention, given purely by way of illustration, and which therefore does not in any way limit the scope of the invention.

IN THE DRAWINGS

Figure 10:
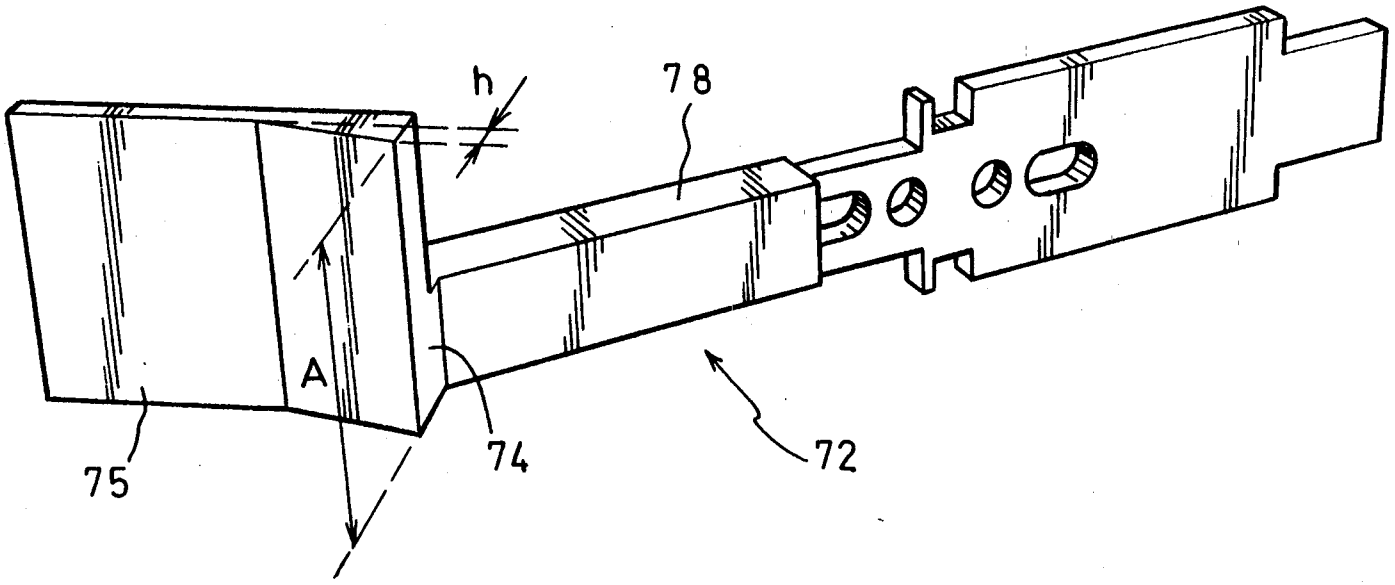
Figure 11:
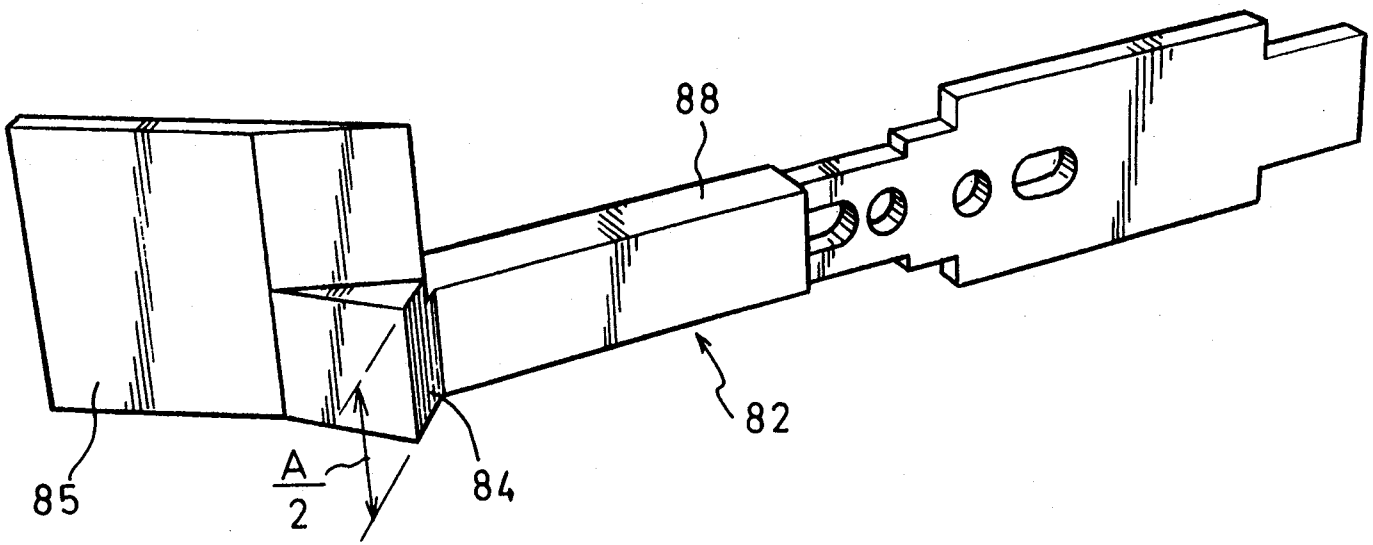

FIGS. *9a*, *9b*, *9c*, *9d* and *9e* represent, in series, the various phases of rotating the display elements for making the writing/display index or system display a given lateral face;

FIG. 10 represents in perspective the writing/display index making it possible to observe that the active surface has a dimension which is essentially equal to the height of the arris of the display element; and FIG. 11 represents in perspective the erasing index making it possible to observe that the active part is half the height of the arris of the display element.

Figure 1:
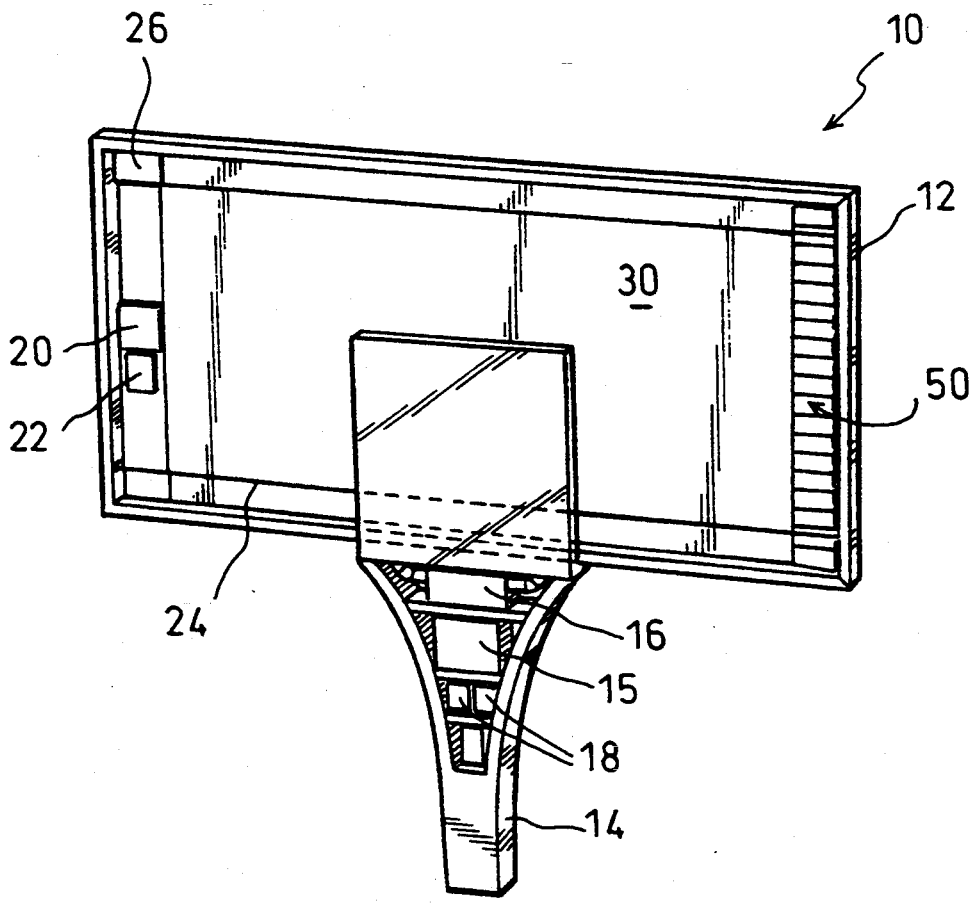
FIG. 1 represents diagrammatically a rear view of the display surface of a display panel with its essential members.

With reference to FIG. 1, a display panel has been represented, carrying the general reference 10, and which forms part of a display system or network as represented in FIG. 1 of the previous document from the inventor FR-A-2,610,438 to which the person skilled in the art may make reference. It is recalled that the display system may comprise a service centre for managing a set of images, which images may be predesigned or designed with the aid of built-in or auxiliary computerized means, and which are then sent by the service centre to at least one peripheral display unit an example of which is represented in FIG. 1. The network may thus include a multitude of peripheral display units such as those represented in FIG. 1. It may be configured for the same image to be sent to all the peripheral display units, or for different images to be sent to the peripheral display units.

Each peripheral display unit is of conventional external structure. These peripheral display structures are most usually arranged outside and their exposure to inclement weather will therefore make it necessary to produce a sealed box structure (12) for protecting the systems and mechanisms of which the display board is composed. FIG. 1 representing a rear view of the peripheral display unit, the rear panel of the display board has been removed in order to view the essential systems and mechanisms. Thus, the box structure (12) is usually raised up by an underframe (14) solidly anchored into the ground. The device for air-conditioning and ventilating the inside of the display panel has been symbolized (at 15 and 16), as has the electrical supply (at 18) used for operating each peripheral display unit and for illuminating it externally. The computer control box has also been represented diagrammatically (at 20) with the associated electronics box (22). The writing (70) and erasing (80) system has also been represented diagrammatically, as has the display surface (30) which is defined by display elements (32) which will be described in more detail with reference to FIGS. 2 to 7. The writing and erasing system (50) is made to move translationally by a device comprising, for example, a transmission belt (24) controlled by an associated drive device (such as 26), as can easily be envisaged by the person skilled in the art.

Figure 2:
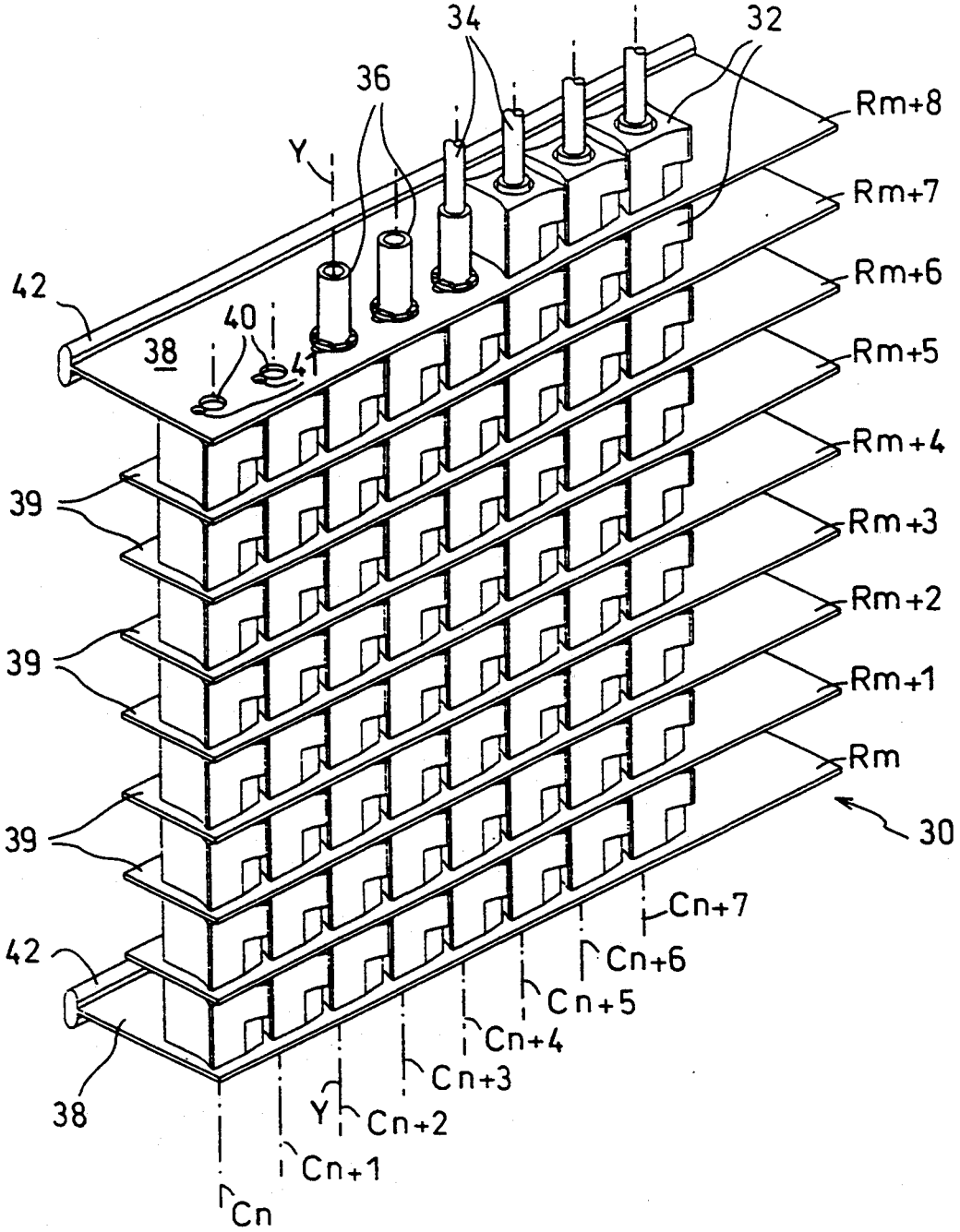
FIG. 2 represents a front view, in perspective, with partial cut-away, of part of the display surface of the display panel of FIG. 1, with some display elements removed for a better understanding of the structure of the display surface; the display elements being positioned so as to view the erasing means.

With reference to FIG. 2, detail can be seen of the structure of the display surface (30) with, in the foreground, the display face itself, and, in the background, the hidden opposite face.

The display surface (30) is formed by a multitude of display elements (32), all of identical structure, arranged at predetermined intervals in the vertical direction and spaced apart by a predetermined distance in the horizontal direction so as to form horizontal rows, for example referenced $R_m$, $R_{m+1}$, $R_{m+2}$, $R_{m+3}$, $R_{m+4}$, $R_{m+5}$, $R_{m+6}$, $R_{m+7}$, $R_{m+8}$, and vertical columns of display elements of which only the columns indexed $C_n$, $C_{n+1}$, $C_{n+2}$, $C_{n+3}$, $C_{n+4}$, $C_{n+5}$, $C_{n+6}$, $C_{n+7}$ are represented here.

It will be observed that according to the invention the display elements (32) are mounted to rotate about a vertical axis of rotation Y—Y, which defines the relative arrangement in rows and columns.

The display elements (32) comprise members in the form of a block which will be described in more detail with reference to FIGS. 3 to 7.

The display elements (32) are preferably mounted to rotate by columns or rows on fixed shafts (such as 34) themselves arranged in columns or rows, as represented, all of these fixed shafts being mounted on a chassis (not shown here), acting as a frame defining the display surface (30) and which may be inserted in the box structure (12) or form an integral part of the latter. Advantageously, the display elements (32) of one same column $C_n$ or $C_{n+1}$, etc. are mounted to rotate on one single fixed rotation shaft (34).

According to the currently preferred embodiment, such as represented, the display elements (32) are mounted to rotate on the fixed shafts (34) indirectly by means of a rotation support element (36) here preferably simultaneously constituting a rotation braking element which can be seen clearly in row $P_{m+8}$ at columns $C_{n+2}$, $C_{n+3}$ and $C_{n+4}$ where the display elements (32) have been removed.

These rotation support elements (36) constituting braking elements (36) will be described in more detail with reference to FIGS. 6 and 7.

It will be observed that the rotation support elements (36) rest on spacing and holding strips (38, 39) which are spaced at a predetermined interval so as to define either columns, or rows of display elements (32) here rows owing to their horizontal arrangement. Preferably, the interval between the aforementioned spacing strips is identical to the distance between the aforementioned fixed shafts (34).

The spacing strips (38, 39) advantageously comprise a plurality of orifices (40) traversed by the aforementioned fixed shafts (34), the said orifices (40) being arranged at the anticipated distance for defining the columns, as represented, or the rows.

According to the currently preferred embodiment, such as represented, at least some spacing strips, here 38, comprise means (42) for supporting and guiding the rotation control means of the display elements (32) and which will be described later. The strips (38) for this reason have a larger dimension than the strips (39).

According to one embodiment variant such as represented, the support and guidance means (42) for example include a moulding arranged on a rear lateral edge (38*a*) of the strips (38).

With reference to FIGS. 3 to 7, the display elements (32) as well as the rotation support elements (36) have been represented in section and in perspective respectively.

Figure 3:
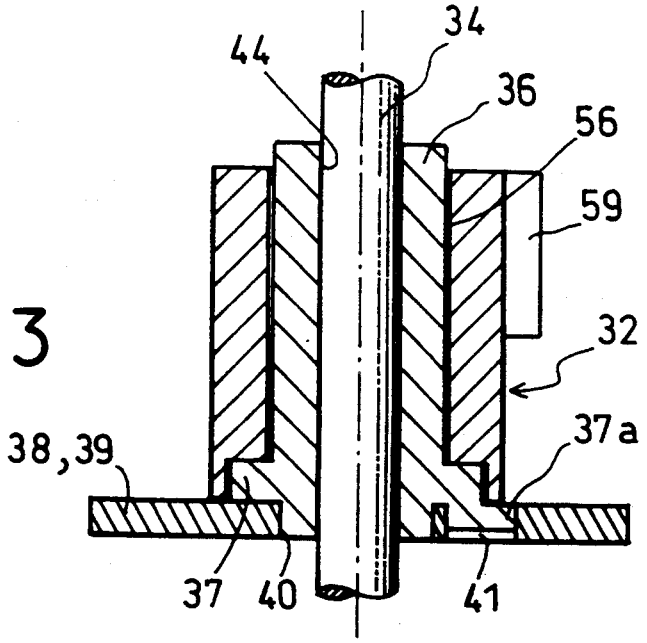
FIG. 3 represents a view in vertical axial section at the level of a display element, of the display surface represented in FIGS. 1 and 2, in the assembled position.

With reference to FIG. 3, the assembly of the display elements (32) on the fixed shafts (34) by means of the rotation support elements (36) can be observed in vertical axial section, which rotation support elements (36) are in some way clipped into the orifices (40) of the spacing strips (38/39). It is observed that the rotation support element (36) comprises, towards its base, an annular shoulder (37) including a stud (37*a*) projecting towards the spacing strip (38/39) in order to be inserted in a small lateral orifice (41) provided in the spacing strips and which can be seen equally well in FIG. 2. The presence of this stud constitutes a means for preventing the rotation support elements (36) of the display elements (32) from rotating. It will be observed that the rotation support element (36) generally has the shape of a hollow cylinder defining a passage (44) for the fixed shafts (34); and the annular shoulder (37) is arranged at a slight distance from the base of the element (36) which distance may correspond, as represented, substantially to the thickness of the spacing strips (38/39).

Figure 7:
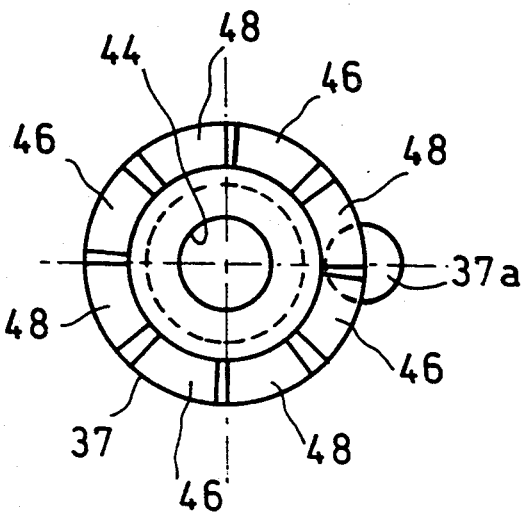
FIG. 7 represents a view from above of the rotation support element represented in FIG. 6.
Figure 5:
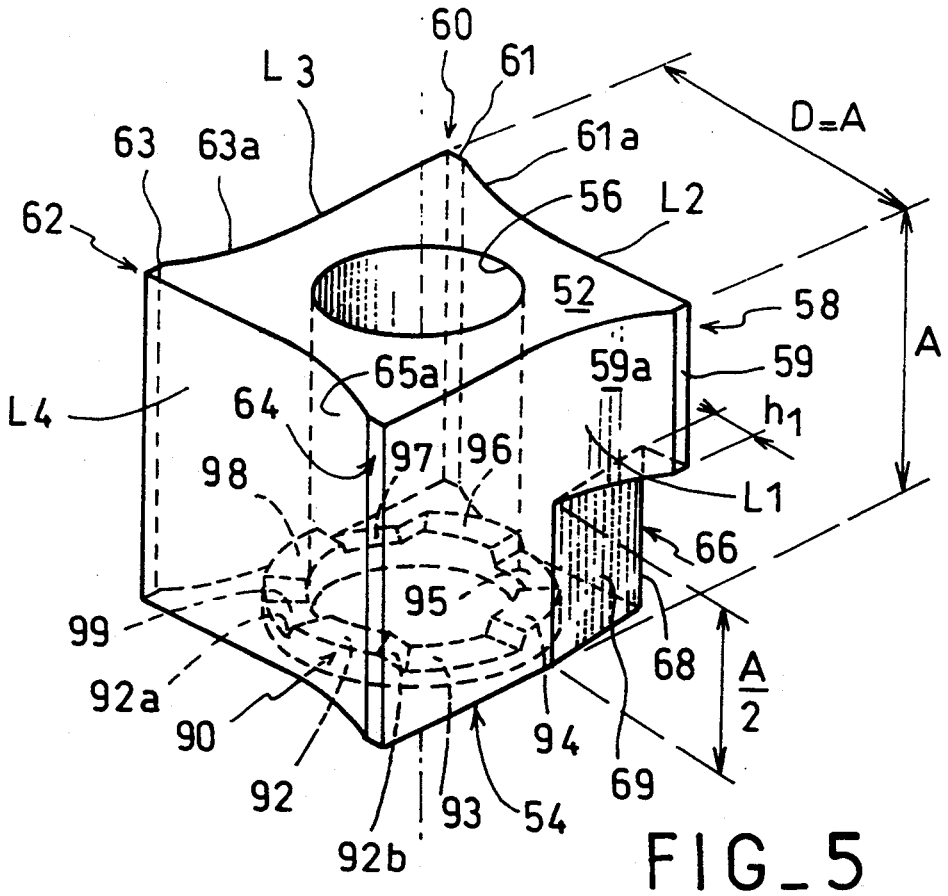
FIG. 5 represents diagrammatically in perspective the structure of an individual display element serving to constitute the display surfaces represented in FIGS. 1 to 3.
Figure 6:
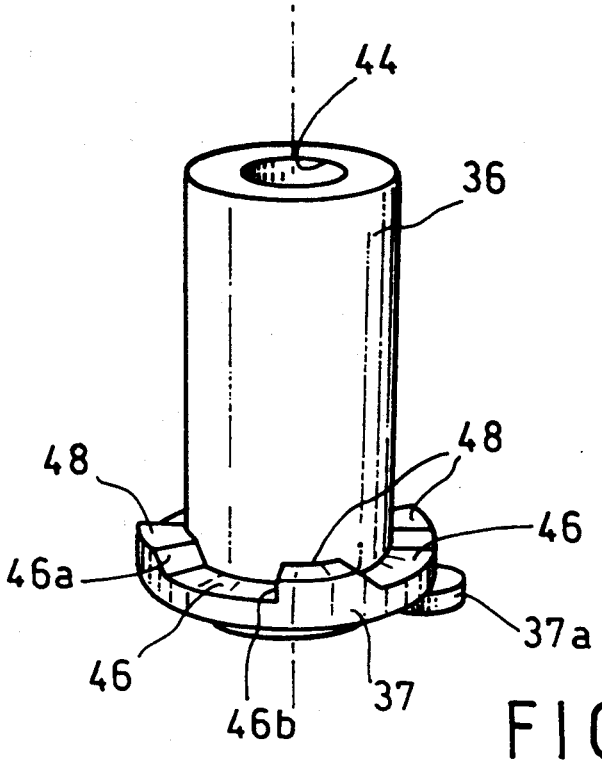
FIG. 6 represents a lateral view in elevation of a rotation support element for a display element, which is represented in section in FIG. 3.

With reference to FIGS. 6, 7, which individually show the rotation support element (36), it will be observed that the upper face of the shoulder (37) which is opposite to the lower face including the stud (41) has cut outs (46) defining protrusions (48) constituting a ratchet-type toothing allowing just one direction of rotation. The cut outs (46) have different slopes to allow just one direction of rotation, for example the slope (46*a*) has a slope of 45° with respect to the vertical and to the slope (46*b*) has a slope of 23° with respect to the vertical, these cut outs are naturally intended to act with a corresponding ratchet-type toothing provided in the display element and which will be described in detail with reference to FIGS. 4 and 5 individually representing the display element (32). Obviously, the number of cut outs (46) and therefore of protrusions (48) is a function of the number of faces of the display element (32).

Figure 4:
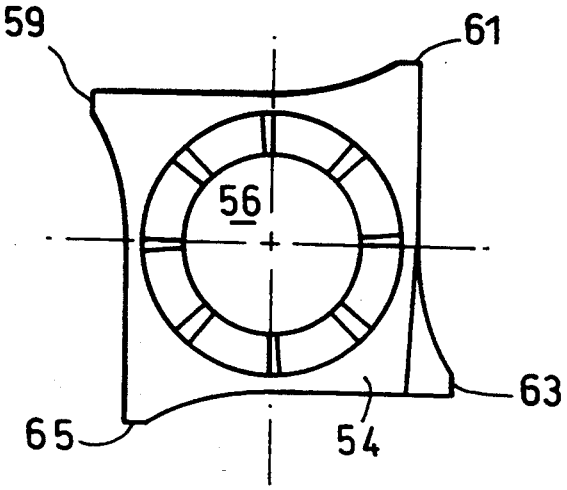
FIG. 4 represents a view from below of the display element represented in FIGS. 1 to 3 and 5.

As represented in FIGS. 4 and 5, the currently preferred embodiment is a display element comprising a member in the form of a block of substantially cubic shape and thus comprising four lateral faces referenced L1, L2, L3 and L4. For example, the face L1 has a cyan colour, the face L2 has a red colour, the face L3 has a white colour and the face L4 has a yellow colour.

According to the present invention, the display element (32) comprises at least one first axial face (52), here the top face, and a second axial face (54), here the bottom, arranged vertically or here horizontally and substantially parallel to one another, joined together by a plurality of lateral faces L1, L2, L3 and L4, here four in number because the display element (32) has the shape of a cube, which faces constitute display surfaces of different colour, and are arranged substantially perpendicularly to the said first and second axial faces (52, 54) defining joining arrises with the latter. The member forming a block (32) comprises an axial through orifice (56) the axis of which is substantially perpendicular to the axial faces (52, 54), and intended to receive the rotation support element (36) described previously, which is itself mounted on the fixed shafts (34). The member forming a block (32) comprises means (58, 60, 62, 64) for rotating about the rotation support elements (36), so that the display element (32) can present each lateral face L1, L2, L3 and L4 in the display position in succession. The rotation means (58 to 64) are intended to be controlled by rotation control means (50) represented diagrammatically in FIG. 1 and which will be described in more detail with reference to FIGS. 8 to 10 respectively for displaying or erasing a given colour in order to define or erase an item of information in conjunction with the other identical display elements (32).

Figure 8:
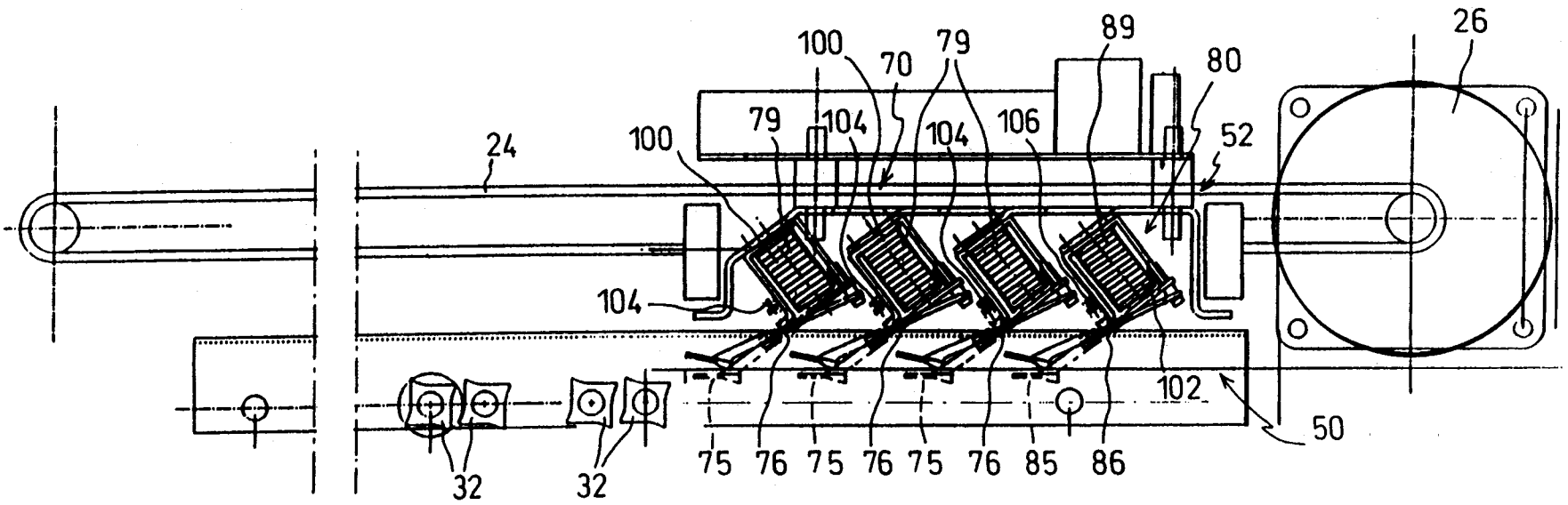
FIG. 8 represents a view from above of the inside of the display panel making it possible to see the structure of the writing/display system or index and of the erasing system or index.

The rotation means (58, 60, 62, 64) comprise, according to the present invention, first mechanical means termed display means referenced perspectively 59, 61, 63, 65 making it possible to display a given colour, and arranged on each of the lateral faces L1, L2, L3, L4 rotationally secured to this lateral face and controlled by the control means (50); and second mechanical means termed erasing means (66) allowing reinitialization with an initial colour, which means are arranged on just one (here the face L1) of the said lateral faces, and controlled by the control means (50) which themselves preferably comprise first control means (70) controlling the first mechanical display means (59, 61, 63, 65) and second control means (80) separate from the first control means (70) and controlling the second mechanical erasing means (66), as will be explained in detail with reference to FIGS. 8 to 10.

According to an advantageous embodiment the first mechanical display means (59, 61, 63, 65) comprise a tooth arranged off centre towards an arris of the face which supports it, as clearly visible in FIG. 4, intended to interact with the aforementioned control means (50), the tooth projecting outwards with respect to the overall surface of the surface which supports it. Preferably, the tooth (59, 61, 63, 65) occupies a substantial part of the dimension of the arris.

According to a currently preferred embodiment, the tooth (59, 61, 63, 65) is integral with the face which supports it and preferably in continuity with this face, for example having a curved surface (59*a*, 61*a*, 63*a*, 65*a*) for joining with the face.

According to a particularly advantageous feature, the curved surface (59*a*, 61*a*, 63*a*, 65*a*) has a dimension which is less than or at most substantially equal to half the dimension of the face which supports it in the rotation direction.

According to another currently preferred feature, the height h of the tooth (59, 61, 63, 65) with respect to the overall surface of the face which supports it lies between 8 and 20% of the dimension D of the said face in the rotation direction.

According to the currently preferred embodiment, as represented, the erasing means (66) preferably comprise a recess (68) produced level with just one arris, here the arris between the face L1 and the face L2 on one lateral face, here the lateral face L1, intended to be opposite the lateral face, here L3, including the erasing colour, that is to say here the colour white.

According to an advantageous embodiment, such as represented, the tooth (61, 63, 65) occupies the whole dimension of the arris over at least three lateral faces (L2, L3, L4 and on a fourth face (L1), the tooth (59) occupies only part of the dimension of the arris in order to define the recess (68) constituting the erasing means (66). Preferably, the recess (68) has a surface (69) which is substantially in the plane of the face L1 which supports it. Preferably, at the level of the arris including the recess (68), the surface (69) of the recess is slightly set back with respect to the general surface of the face L1 including the recess (68) so as to facilitate the passage of the erasing means, which is visible in FIG. 4, where it can be seen that the depth h1 of the recess (68) is greater than the height h of the tooth (59).

According to a currently preferred embodiment, the member in the form of a block constituting the display element (32) is produced from an injectable material, using an injection technique, preferably made from an injectable plastic such as polybutyleneterephthalate.

In contrast, it is advantageous for the colours of the lateral faces to be obtained by a hot-marking technique, for example by depositing a film of given colour on the lateral face, possibly followed by depositing a lacquer giving mechanical strength preventing the colour from being damaged and protecting the colour in particular against ultraviolet radiation. These means are also claimed as such.

According to a currently preferred embodiment, the display element (32) comprises an element (90) for braking the rotation of the block-shaped member, the element preferably being arranged in the mass of an axial face, here the face (54). This rotation braking element (90) comprises, in a similar manner to the rotation support element (36) a ratchet-type toothing allowing just one direction of rotation by forming, in the mass of the axial face (54) recesses (92, 94, 96, 98) intended to interact with the protrusions (48) of the ratchet-type toothing of the element (36). Here also the recesses (92 to 98) include a flat (such as 92*b*) with a slope of 45° with respect to the vertical and a flat (92*a*) with a slope of 23° with respect to the vertical to allow just one direction of rotation. Owing to the recesses (92 to 98) the spaces between these recesses thus in some way constitute respectively teeth (referenced 93, 95, 97, 99). The recesses, like the teeth, are four in number taking account of the fact that the display element is here of cubic form and includes four lateral display faces L1 to L4. FIG. 5 makes it possible to observe under the display element (32) in the form of a cube and also makes it possible to observe clearly the teeth (59 to 65) and the ratchet-type toothing (90) defined in the mass of the axial face (54).

With reference to FIGS. 8 to 11, control means (50) will be described more precisely, the control means comprising the reading or display means (70) and the erasing means (80). First of all, it can be seen from FIG. 8 that the writing/display means (70) and the erasing means (80) are mounted on a common longitudinal support structure constituting a carriage (52) driven in translational movement behind the display surface which is defined by the set of display elements (32), being guided by the support and guiding means (42) of the spacing strips (38), by the interaction with guide rollers (54) as can be clearly understood by the person skilled in the art. This longitudinal structure forming a carriage (52) comprises a plurality of identical display/-writing indexes (72) and erasing indexes (82) respectively, moving in parallel to the rear of the plane formed by the display surface which consists of the display elements (32), and this being per row R of display elements (32).

This longitudinal structure forming a carriage (52) is thus subdivided into a first longitudinal display structure (70) provided with a plurality of display indexes (72) moving in parallel to the rear of the plane formed by the display surface consisting of the display elements (32) and in the plane of the first aforementioned mechanical display means, that is it to say in practice level with the tooth (59), and a second longitudinal erasing structure (80) provided with one or more erasing indexes (82), in particular one as represented, or up to four indexes, for a member forming a block consisting of a block with four lateral faces forming four display faces of different colour, this second longitudinal structure (80) also moving in parallel to the rear of the plane formed by the display surface which consists of the display elements (32) but in the plane of the second aforementioned mechanical erasing means (66), that is to say at the level of the recess (68) i.e. in the lower part of the teeth (61, 63, 65), which makes it possible to erase as can be understood by the person skilled in the art and as will be explained later on in the context of operation.

According to a preferred embodiment, the second longitudinal erasing structure and the first longitudinal display structure (70) are mounted in common on the same chassis consisting of the carriage (32) so as to be moved simultaneously. It will be noted that the carriage (52) is controlled in displacement by means of the transmission belt (24) also visible in FIG. 1, and of a drive motor (26) which may be a motor moved step by step or a DC motor equipped with an encoder, tachometer and variator in order to know precisely the position of the carriage (52) by electronically counting the number of revolutions made by the motor. The precise knowledge of the position of the carriage is in fact important for actuating the display and/or erasing indexes as will be explained later.

The structure of the display indexes (72) is as follows, with reference to FIGS. 10 and 11; each display index (72) comprises an active surface (74) which, in the working position, abuts in its movement against the aforementioned tooth (59, 61, 63 or 65) in order to rotate the display element (32), whereas the erasing index (82) also has an active part (84) which, in the working position, is arranged level with the aforementioned recess (68).

Advantageously, the display indexes (72) have the shape of a strip (75) including a front edge and a rear edge, the front edge constituting a stop for rotating the display element, and thus defining the active surface (74). Likewise, the erasing indexes (82) comprise a strip (85) including a front edge and a rear edge, the front edge constituting a stop for rotating the display element (32) and thus defining the active surface (84).

According to the embodiment represented, the aforementioned strips (75, 85) have an excess thickness at their front edge defining the stop forming the active surface (74, 84), the difference in thickness preferably being substantially identical to the height h of the tooth (59, 61, 63, 65) so that the rear edge bears against the tooth of a given face and the front edge bears on the surface of the face of a display element which precedes the display element the tooth of which is to be tilted for rotating the element, as is represented in the working position in FIGS. 8, 9 and 10.

It should, however, be noted, that the excess thickness forming the active surface (74) of the display indexes has a dimension which corresponds substantially to the overall dimension A of the arris of the support elements (32), here in the form of a cube, whereas the total dimension of the active surface (84) of the erasing strips (85) corresponds substantially to the height of the recess (68) which, according to a preferred embodiment, such as represented, extends over half the height of the arris A (that is to say A/2). In this way, the excess thickness defining the active surface (84) of the strips (85) extends over half the height of these strips, these strips having a dimension which is identical to the strips (75) by extending over the entire dimension of the arris (A) of the elements (32).

In contrast, each of the display (72) and erasing (82) indexes is mounted so that it can move into a retracted, unoperational position, and an advanced, operational position, the retracted positions being represented in solid line and the operational position being represented in faint line in FIG. 8. In order to do this, each strip (75, 85) is mounted so that it pivots on a pivot spindle (76, 86) respectively by means of an arm (78, 88) connected at one end to the said strip (75 or 85) and at the other opposite end interacts with a pivoting means (79, 89). The means (79, 89) for pivoting the display/writing and erasing indexes preferably comprises an electromagnet device (100, 102) which, when it is activated, brings the strips (75, 85) with their active surface (74, 84) into the operational position represented in faint line in FIG. 8 in order to rotate a display element (32) as represented in FIGS. 9*a* to 9*e*, whereas in the non activated position of the electromagnets (100, 102) a return means such as a spring (104, 106) returns the strips (75, 85) to the retracted non-operational position.

Thus the structure of the erasing means is essentially identical to that of the writing/display means which constitutes an advantage of the invention, with the sole exception of the active part (84) of the erasing indexes (72) and of a dimension A/2 as compared to the dimension A of the active part (74) of the writing indexes (72).

Figure 9A:
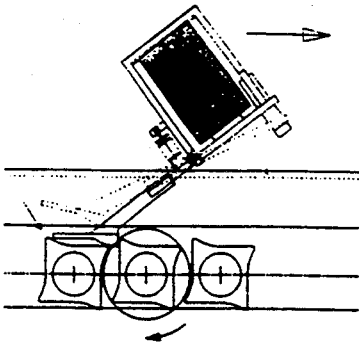
Figure 9B:
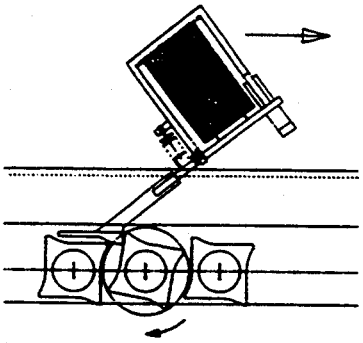
Figure 9C:
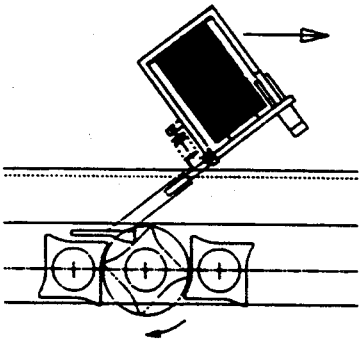
Figure 9D:
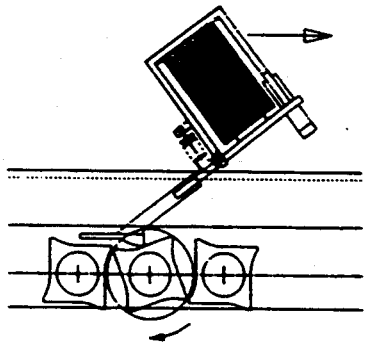
Figure 9E:
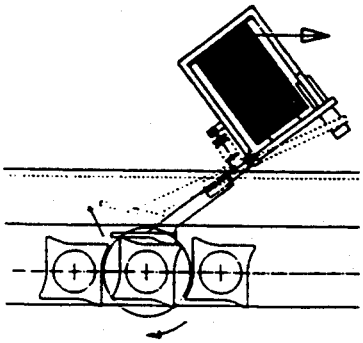

The procedure for displaying or writing appears clearly from consideration of FIGS. 9*a* to 9*e*. In position 9*a* the retracted position has been represented in faint line and the active position in solid line. In the active position, the strip (75) comes to bear for example on the display element (32) of the column $C_n$ in order to rotate the element (32) of the column $C_{n+1}$. FIG. 9*a* represents just the position in which the active surface (74) of the strip (75) abuts against a tooth of the display element (32) of the column $C_{n+1}$, that is to say just before this element rotates. FIG. 9*b* represents the start of rotation of the display element (32) of the column $C_{n+1}$, FIG. 9*c* represents an intermediate rotation position, as does FIG. 9*d*. FIG. 9*e* represents the end-of-rotation position. It is thus observed that each index here makes it possible to rotate through a quarter of a turn in order to display the next face of the display element (32). It is understood that in order to display all the faces, it is sufficient to use three indexes for displaying the other three faces. As regards erasing, it is understood that a single erasing index may be used, by producing one or more passages, so as to be sure to have all the display elements in the position in which the erasing index becomes inactive with respect to the rotation of the display elements (32), by passing systematically through the recess (68). In general, this operation of completely erasing the display surface takes place only from time to time between various displays of images.

It will be noted that in FIG. 2, for better understanding, the display elements are represented with the recesses opposite the mouldings (42). However, when the display surface is in the entirely erased position, the position of the display elements (32) is the reverse and all the recesses face the mouldings (42) so as to display the opposite face, that is to say the white face (see FIG. 4) as the erased surface.

The action of the erasing indexes appears clearly from consideration of FIG. 9*a* to 9*e*, the rotational movement of the display elements (32) being the same as that represented in FIGS. 9*a* to 9*e*.

It can thus be understood that it is possible, with the invention, to display any image in a foolproof and reliable way, with a simplified structure. The general operation of the peripheral display unit constituted by the display panel represented in FIGS. 1 to 11 is, moreover, known to the person skilled in the art, particulary taking into account the previous application FR-A-2,610,438 by the same inventor, to which the person skilled in the art may make reference.

Naturally, the invention comprises all the means constituting technical equivalents to the means described as well as their various combinations. The invention moreover covers any feature which appears to be novel in respect to any state of the art on the basis of the previous description incorporating FIGS. 1 to 11 which constitute an integral part of the present invention and therefore an integral part of the present description.

I claim:

1. Display element including a member in the form of a block including at least one first axial face (52) and one second axial face (54) arranged vertically or horizontally substantially mutually parallel and joined together by a plurality of lateral faces (L1, L2, L3, L4) constituting display surfaces of different colours, and arranged substantially perpendicularly to the said first and second axial faces, defining junction arrises with the latter, the said member forming a block including an axial through orifice (56) the axis of which is substantially perpendicular to the said axial faces and intended to receive a rotation support element, the said member forming a block comprising means for rotating about the said rotation support element, so that it can present each lateral face in the display position in succession, the said rotation means being intended to be controlled by rotation control means (50) for displaying or erasing a given colour in order to define or erase an item of information in conjunction with other identical display elements, characterized in that the rotation means (58, 60, 62, 64) comprise first mechanical means termed display means (59, 61, 63, 65) allowing a given colour to be displayed, and arranged on each of the lateral faces, rotationally secured to the latter, and controlled by the said control means (50), and second mechanical means termed erasing means (66) making it possible to reinitialise an initial colour, arranged on just one of the said lateral faces, controlled by the said control means (50); preferably, the control means (50) comprise first control means (70) controlling the first mechanical display means (59, 61, 63, 65) and second control means (80) separate from the first control means (70) and controlling the second mechanical erasing means (66).

2. Display element according to claim 1, characterized in that the first mechanical display means comprise a tooth arranged off centre towards one arris of the face which supports it, intended to interact with the aforementioned control means (50), the said tooth projecting outwards with respect to the overall surface of the said face which supports it.

3. Display element according to claim 2, characterized in that the tooth occupies a substantial part of the dimension of the arris.

4. Display element according to claim 2 or 3, characterized in that the tooth is integral with the face which supports it and preferably in continuity with this face, for example having a curved surface for joining to the face.

5. Display element according to claim 4, characterised in that the curved surface has a dimension which is less than or at most substantially equal to half the dimension of the face which supports it in the rotation direction.

6. Display element according to one of claims 2 to 5, characterized in that the height (h) of the tooth with respect to the overall surface of the face which supports it lies between 8 and 20% of the dimension (D) of the said face in the rotation direction.

7. Display element according to one of claims 1 to 6, characterized in that the aforementioned erasing means (66) comprise a recess (68) produced level with just one arris on a lateral face which is intended to be opposite the lateral face including the erasing colour.

8. Display element according to claim 7, characterized in that the aforementioned tooth (61, 63, 65) occupies the whole dimension of the arris on at least three aforementioned lateral faces (L2, L3, L4) and on a fourth face (L1) the said tooth (59) occupies only part of the dimension of the arris in order to define the aforementioned recess (68) constituting the erasing means (66).

9. Display element according to claim 8, characterized in that the recess (68) has a surface which is substantially in the plane of the face which supports it.

10. Display element according to claim 8 or 9, characterized in that level with the arris including the recess (68), the surface of the recess is slightly set back with respect to the overall surface of the face (L1) including the recess (68) so as to facilitate the passage of the erasing means (80).

11. Display element according to one of claims 1 to 10, characterized in that the aforementioned member in the form of a block is of substantially cubic shape and thus comprises four lateral faces.

12. Display element according to one of claims 1 to 11, characterized in that the member in the form of a block is produced from an injectable material, using an injection technique, preferably made from an injectable plastic such as polybutyleneterephthalate.

13. Display element according to claim 12, characterized in that the colours of the lateral faces are obtained by a hot marking technique, for example by depositing a film of given colour on the lateral face, possibly followed by depositing a lacquer giving a mechanical strength preventing the colour from being damaged and protecting the colour particularly against ultraviolet radiation.

14. Display element according to one of the preceding claims, characterized in that it comprises an element (90) for braking the rotation of the block-shaped member, the element preferably being arranged in the mass of an axial face.

15. Display element according to claim 14, characterized in that the aforementioned braking element comprises a ratchet-type toothing allowing just one direction of rotation, including as many teeth as there are display surfaces, preferably including four teeth when the display element includes only four lateral faces.

16. Display panel comprising a structure with a display surface formed by a multiplicity of display elements arranged at predetermined intervals in the vertical direction and spaced apart by a predetermined distance in the horizontal direction in order to form horizontal rows of display elements ($R_m$) and vertical columns of display elements ($C_n$), characterized in that each display element is such as defined according to any one of claims 1 to 15.

17. Display panel according to claim 16, characterized in that the display elements are mounted so to rotate about a vertical axis of rotation (Y—Y), the display elements being mounted so as to rotate per column ($C_n$) or row ($R_m$) on fixed rotation shafts arranged in columns or rows, all of these fixed shafts being mounted on a chassis acting as a frame defining the aforementioned display surface; the display elements rest on spacing and holding strips which are spaced apart at predetermined intervals so as to define either columns, or rows of display elements.

18. Display panel according to claim 17, characterized in that the interval between the aforementioned spacing strips is identical to the distance between the aforementioned fixed shafts.

19. Display panel according to claim 18, characterized in that the spacing strips comprise a plurality of orifices traversed by the aforementioned fixed shafts, the said orifices being arranged at the anticipated distance in order to define the aforementioned columns or rows.

20. Display panel according to one of claims 17 to 19, characterized in that at least some of the aforementioned spacing strips (38) comprise means for supporting and guiding the aforementioned rotation control means (50).

21. Display panel according to claim 20, characterized in that the aforementioned support and guidance means comprise a moulding (42) on a rear lateral edge of some strips (38).

22. Display panel according to claim 21, characterized in that the aforementioned rotation control means comprise a longitudinal structure provided with a plurality of display/write indexes (72) and erasing indexes (80) per aforementioned line or column, moving parallel to the rear of the plane formed by the display surface which consists of the display elements.

23. Display panel according to claim 22, characterized in that it comprises first rotation control means (70) comprising a first longitudinal display structure provided with a plurality of display indexes (72) which can preferably move individually and independently, per line or column, moving in parallel to the rear of the plane formed by the display surface which consists of the display elements (32) and in the plane of the first aforementioned mechanical display means (58).

24. Display panel according to claim 22 or 23, characterized in that it comprises second rotation control means (80), comprising a second longitudinal erasing structure provided with one or more erasing indexes (82), in particular one (82) or up to four indexes for a member forming a block consisting of a cube with four lateral faces forming four display faces of different colour.

25. Display panel according to one of claims 23 or 24, characterized in that the display indexes (72) are mounted so that they pivot independently, individually, about a pivot spindle actuated by electromechanical or pneumatic control means; advantageously the erasing index(es) (82) is/are mounted so that it (they) can move, and preferably so that it (they) pivot(s) about an associated pivot spindle (86) actuated by electromechanical or pneumatic control means.

26. Display panel according to one of claims 24 or 25, characterized in that the second longitudinal erasing structure (80) is mounted on the first longitudinal display structure (70), and in front of this first longitudinal structure.

27. Display panel according to one of claims 22 to 26, characterized in that the indexes (72, 82) are arranged with a predetermined identical spacing which is preferably equal to or greater than twice the distance separating the rotation spindle of two adjacent display elements.

28. Display panel according to one of claims 23 to 27, characterized in that each aforementioned display index (72) comprises an active surface (74) which, in the working position abuts in its displacement against the aforementioned tooth in order to rotate the aforementioned display element whilst the aforementioned movable erasing index (82) has an active part which, in the working position, is arranged level with the aforementioned recess.

29. Display panel according to claim 28, characterized in that the display indexes (72) have the form of a strip (76) including a front edge and a rear edge, the front edge constituting a stop forming the active surface (74) for rotating the display element (32).

30. Display panel according to claim 29, characterized in that the aforementioned strip (75, 85) has an excess thickness at its front edge defining a stop, the difference in thickness preferably being substantially identical to the height of the aforementioned tooth so that the rear edge comes to bear against the tooth of a given face and the front edge bears on the surface of the said face of a display element preceding the display element the tooth of which is to be tilted by rotating the said element.

31. Display panel according to claim 29 or 30, characterized in that the erasing index (82) comprises a strip (85) including a front edge and a rear edge, the front edge including an excess thickness defining a stop, on only one part of its dimension, corresponding to the dimension of the aforementioned recess (68), the said stop forming the active surface (74) being intended to be positioned facing the said recess (68).

32. Display system, characterized in that it comprises at least one display panel such as defined according to any one of claims 16 to 31, which preferably forms part of a peripheral display unit, advantageously equipped with an internal computer system.

33. Display system according to claim 32, characterized in that it comprises a service centre for managing a set of images sent to at least one peripheral display unit comprising at least one aforementioned display panel (10).

* * * * *